US007786372B2

(12) United States Patent
Sawada et al.

(10) Patent No.: US 7,786,372 B2
(45) **Date of Patent: *Aug. 31, 2010**

(54) WIND MUSICAL INSTRUMENT WITH PITCH CHANGING MECHANISM AND SUPPORTING SYSTEM FOR PITCH CHANGE

(75) Inventors: Shuichi Sawada, Shizuoka-ken (JP); Hideo Suzuki, Shizuoka-ken (JP); Akihiko Komatsu, Shizuoka-ken (JP); Nariyasu Yaguchi, Shizuoka-ken (JP); Yoshinori Hayashi, Shizuoka-ken (JP); Souichi Takigawa, Shizuoka-ken (JP)

(73) Assignee: Yamaha Corporation, Shizuoka-Ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/686,539

(22) Filed: Mar. 15, 2007

(65) Prior Publication Data

US 2007/0234887 A1 Oct. 11, 2007

(30) Foreign Application Priority Data

Mar. 24, 2006 (JP) ..... 2006-084010

(51) Int. Cl.
*G10H 3/00* (2006.01)

(52) U.S. Cl. ..... 84/723; 84/380 R; 84/385 R; 84/600

(58) Field of Classification Search ..... 84/380 R, 84/385 R, 723, 600
See application file for complete search history.

(56) References Cited

U.S. PATENT DOCUMENTS 1,880,961 A 10/1932 Kingsley
2,301,184 A 11/1942 Arnold
3,767,833 A 10/1973 Noble et al.
4,527,456 A * 7/1985 Perkins et al. ..... 84/654
4,899,631 A 2/1990 Baker
4,957,029 A 9/1990 Kähönen
4,981,457 A 1/1991 Iimura et al.
4,993,307 A 2/1991 Sakashita
5,149,904 A 9/1992 Kamiya et al.
5,276,272 A 1/1994 Masuda
5,300,729 A 4/1994 Tokunaga et al.
5,403,966 A 4/1995 Kawashima et al.

(Continued)

FOREIGN PATENT DOCUMENTS

DE 38 06 396 9/1989

(Continued)

OTHER PUBLICATIONS

Translation of NL 1011954 C2.*

*Primary Examiner*—Walter Benson
*Assistant Examiner*—Kawing Chan
(74) *Attorney, Agent, or Firm*—Dickstein Shapiro, LLP

(57) ABSTRACT

Three valve assemblies are linked with finger buttons and inserted into a pipe structure of a trumpet for changing the length of air column, and a supporting system assists a player in fingering on the finger buttons; sensors are adhered to the finger buttons so as to supply a detecting signal representative of force exerted on the finger buttons by the player to a controlling unit; when the force exceeds over a threshold, the controlling unit energizes actuators connected to the valve assemblies so as to make the player feel the valve assemblies lightly changed.

17 Claims, 12 Drawing Sheets

U.S. PATENT DOCUMENTS

| | | | | |
|---|---|---|---|---|
| 5,668,340 | A * | 9/1997 | Hashizume et al. | 84/742 |
| 5,929,361 | A | 7/1999 | Tanaka | |
| 7,049,503 | B2 | 5/2006 | Onozawa et al. | |
| 7,112,735 | B2 | 9/2006 | Shire | |
| 7,402,738 | B2 * | 7/2008 | Sawada et al. | 84/380 R |
| 2005/0076774 | A1 * | 4/2005 | Sakurada | 84/616 |
| 2005/0098020 | A1 * | 5/2005 | Glazer | 84/388 |
| 2005/0126367 | A1 * | 6/2005 | Bonnat | 84/376 R |
| 2005/0145100 | A1 | 7/2005 | Ramstein | |
| 2005/0204906 | A1 | 9/2005 | Lengeling | |
| 2005/0217464 | A1 * | 10/2005 | Onozawa et al. | 84/723 |
| 2006/0090633 | A1 | 5/2006 | Muramatsu | |
| 2006/0185503 | A1 | 8/2006 | Fujiwara | |
| 2007/0234887 | A1 | 10/2007 | Sawada et al. | |
| 2007/0277666 | A1 | 12/2007 | Laukat et al. | |
| 2008/0017014 | A1 * | 1/2008 | Suzuki | 84/385 R |

FOREIGN PATENT DOCUMENTS

| | | | |
|---|---|---|---|
| EP | 1840869 | | 10/2007 |
| GB | 1 004 311 | | 9/1965 |
| JP | 03-091800 | A | 4/1991 |
| JP | 06-222752 | | 8/1994 |
| JP | 10254437 | A | 9/1998 |
| JP | 2001-109462 | | 4/2001 |
| JP | 2004-177828 | | 6/2004 |
| JP | 2004-177828 | A | 6/2004 |
| JP | 2004-334141 | | 11/2004 |
| JP | 2006-154505 | A | 6/2006 |
| JP | 2007-256850 | | 10/2007 |
| NL | 1011954 | | 11/2000 |

* cited by examiner

WIND MUSICAL INSTRUMENT WITH PITCH CHANGING MECHANISM AND SUPPORTING SYSTEM FOR PITCH CHANGE

FIELD OF THE INVENTION

This invention relates to a wind musical instrument and, more particularly, to a wind instrument with a key mechanism or a valve mechanism for changing the pitch of tones and a supporting system for assisting the player in fingering.

DESCRIPTION OF THE RELATED ART

A trumpet, a tuba and horns belong to the metal wind instrument. A player puts his or her mouth on a mouthpiece, and buzzes. Then, a column of air, which is formed in the pipe, vibrates so that tones are radiated from the bell of the metal wind instrument. The metal wind instrument is equipped with a valve mechanism, and one of the methods for changing the pitch of tones is to depress and release finger buttons or keys of the valve mechanism.

When the player depresses the finger button or buttons, the force is transmitted from the finger button or buttons to the valve or valves, and the valve is opened so as to change the length of the column of air. Return springs exert the elastic force on the finger button and buttons, and friction takes place between metal parts against the movement of the finger buttons. The finger buttons are to be depressed from the rest positions to the end positions over the stroke, which is not short. The player needs to move the finger button or buttons over the relatively long stroke against the various sorts of resistances. If the player releases the finger button or buttons on the way to the end position or positions, the finger button or buttons merely make the associated valve or valves incompletely open, and the tone is not produced at the target pitch through the metal wind instrument. For this reason, players feel the change of pitch through the fingering not easy. The difficulty becomes serious in performances along fast music passages.

The metal wind instruments are designed for adult players. The returns springs are not weak, and the finger buttons are arranged to be fit to the fingers of adult players. Moreover, the large-sized metal wind instruments such as tubas have large valves, and, accordingly, the finger buttons are widely spaced from the adjacent finger buttons. For this reason, it is not easy for children, handicapped persons and old people to play pieces of music on the metal wind instruments.

An automatic playing system for wind instruments is disclosed in Japanese Patent Application laid-open No. 2004-177828. The automatic playing system comprises an air compressor, an air valve, an artificial mouth, valve actuators and a controlling unit. The valve actuators are provided in association with the finger buttons or keys connected to the valves inside the wind instrument. The compressed air is supplied through the air valve to the artificial mouth, and the artificial mouth gives rise to the vibrations of the column of air in the wind instrument. The airflow is controlled by means of the air valve, and the valves are changed between the open state and the closed state by means of the valve actuators. A set of music data codes is supplied to the controlling unit. The controlling unit analyzes the music data codes, and energizes the valve actuators at proper timing to change the pitch of tones through the valves of the wind instrument. However, the automatic playing system does not aim at supporting children, handicapped persons and old people. In other words, the wind instrument is performed by the automatic playing system instead of a human player, but is not performed by a human player with the assistance of the automatic playing system. Thus, the automatic playing system disclosed in the Japanese Patent Application laid-open does not make it possible to play wind instruments with the fingers of a child, handicapped person or old person.

SUMMARY OF THE INVENTION

It is therefore an important object of the present invention to provide a wind instrument, which is easily performable by a child, a handicapped person or an old person.

It is also an important object of the present invention to provide a supporting system, which is combined with a wind instrument for assisting the child, handicapped person or old person in a performance on the wind instrument.

To accomplish the object, the present invention proposes to assist a human player in fingering on a pitch changing mechanism by means of a supporting system.

In accordance with one aspect of the present invention, a wind musical instrument for producing tones comprising a pipe structure defining a column of air therein, a vibration exciter connected to the pipe structure and used to give rise to vibrations of the column of air in the pipe structure, a pitch changing mechanism provided on the pipe structure and selectively manipulated for changing length of the column of air, and a supporting system provided in association with the pitch changing mechanism for assisting a human player in fingering on the pitch changing mechanism.

In accordance with another aspect of the present invention, there is provided a supporting system combinable with a wind musical instrument comprising at least one sensor provided in association with a pitch changing mechanism of the wind musical instrument and producing a detecting signal representative of fingering of a human player on the pitch changing mechanism, at least one actuator provided in association with the pitch changing mechanism and responsive to a driving signal so as to assist the human player in the fingering, and a controlling unit connected to the aforesaid at least one sensor and the aforesaid at least one actuator, analyzing the detecting signal for an intention of the human player and supplying the driving signal to the aforesaid at least one actuator for assisting the human player in the fingering.

BRIEF DESCRIPTION OF THE DRAWINGS

The features and advantages of the wind instrument and supporting system will be more clearly understood from the following description taken in conjunction with the accompanying drawings, in which FIGS. 13 and 14 are schematic side views showing yet another supporting system of the present invention at different valve positions.

DESCRIPTION OF THE PREFERRED EMBODIMENTS

Figure 1:
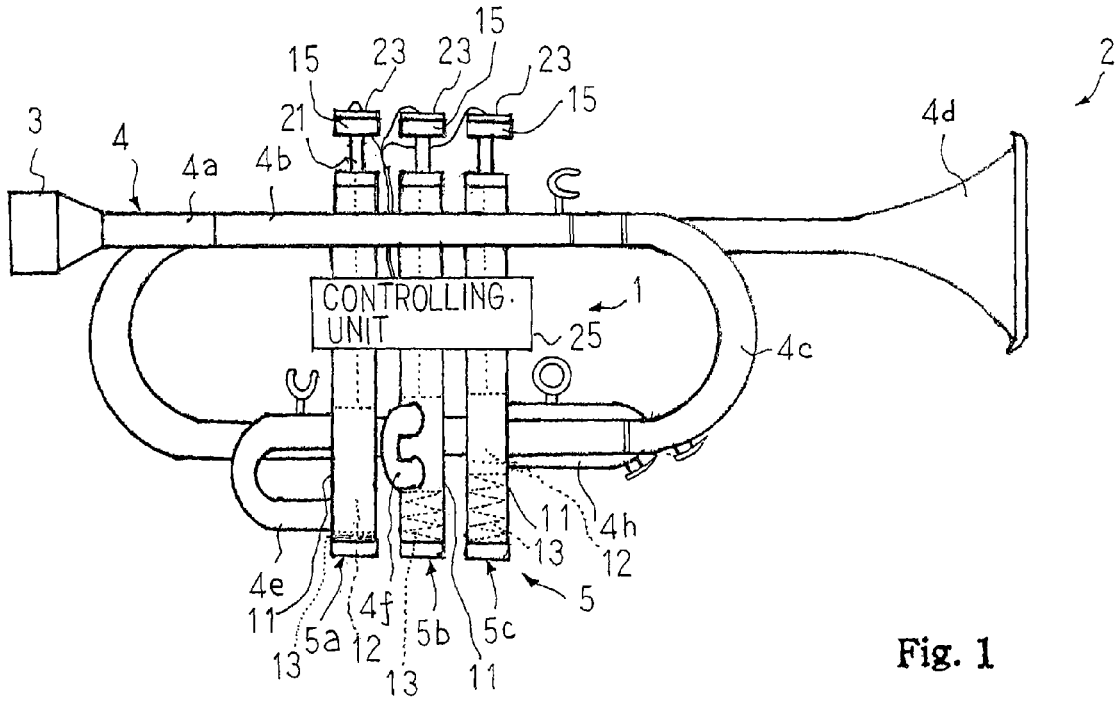
FIG. 1 is a schematic side view showing a trumpet equipped with a supporting system of the present invention.

A wind musical instrument embodying the present invention is used for producing tones, and comprises a pipe structure, a vibration exciter, a pitch changing mechanism and a supporting system. A column of air is defined in the pipe structure, and the tones are produced through vibrations of the column of air. The vibration exciter is connected to the pipe structure, and the pitch changing mechanism is provided on the pipe structure. When a human player wishes to play a music passage on the wind musical instrument, he or she gives rise to the vibrations of column of air by means of the vibration exciter for producing the tones, and changes the pitch of tones through fingering on the pitch changing mechanism. The pitch changing mechanism makes the valve assembly 5*a*, a second valve assembly 5*b* and a third valve assembly 5*c*. The first valve assembly 5*a*, second valve assembly 5*b* and third valve assembly 5*c* are respectively associated with the first valve slide 4*e*, second valve slide 4*f* and third valve slide 4*h*, and add additional air columns in the first valve slide 4*e*, second valve slide 4*f* and third valve slide 4*h* to the main air column extending from the mouthpiece receiver 4*a* to the bell 4*d*.

When any one of or all of the first, second and third valve assemblies 5*a*/5*b*/5*c* are described, the valve assembly is labeled with reference numeral 10. In other words, when term "valve assembly 10" is found in the following description, the "valve assembly 10" means the first valve assembly 5*a*, second valve assembly 5*b* or third valve assembly 5*c*.

The valve assembly has a valve casing 11, a valve 12, a return spring 13, a finger button 15 and a rod 21. The three calve casings 11 are fixed to the pipe structure 4, and define cylindrical spaces inside thereof, respectively. The valve 12 is provided inside each of the valve casings 11 in such a manner to be slidable in a direction parallel to the centerline of the associated cylindrical space. The return spring 13 is provided between the bottom portion of the valve case 11 and the bottom surface of the valve 12, and urges the valve 12 in a direction spaced from the bottom portion of the valve casing 11.

The valve 12 is connected to the rod 21, and the rod 21 projects from the valve casing 11. The finger button 15 is secured to the leading end of the rod 21 so that a player can make the valve slide in the direction toward the bottom portion of the valve casing 11 against resistance, i.e., the elastic force of return spring 13 and friction between the inner surface of the valve casing 11 and the valve 12.

The trumpet is designed for adult players so that the elastic force of the return spring 13 is strong. The adult player feels the resistance against the valve movement proper. However, the resistance is too heavy for a child, a handicapped person and an old person quickly to move the valve 12 against the resistance.

Figure 2:
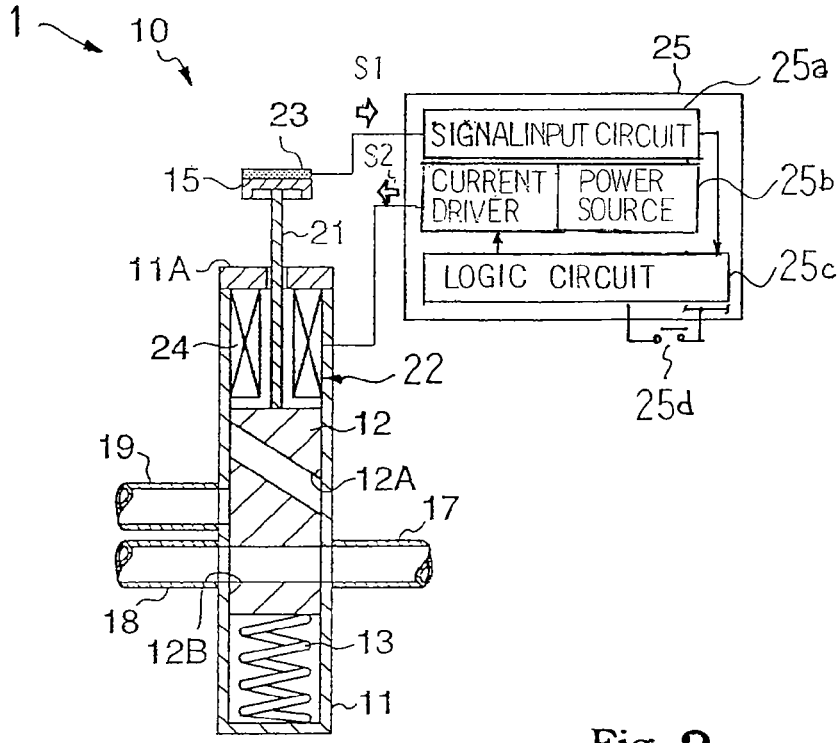
FIG. 2 is a schematic cross sectional view showing the structure of a valve actuator and the structure of an associated valve assembly in closed state.

Turning to FIG. 2 of the drawings, the supporting system 1 includes solenoid-operated valve actuators 22, pressure sensors 23 and a controlling unit 25. The pressure sensors 23 are formed by pressure-sensitive sheets, respectively, and convert force exerted on the finger buttons 15 to a detecting signal S1. The solenoid-operated valve actuators 22 are responsive to a driving signal S2, and convert the electric current to magnetic force.

As described hereinbefore, the valve assembly 10 stands for any one of the first, second and third valve assemblies 5*a*, 5*b* and 5*c*, the valve assembly 10 is connected to different portions of the pipe structure 4. For this reason, an inlet portion and outlet portions of the pipe structure 4 are labeled with 17 and 18/19 in FIG. 2 and other figures numbered greater than 2. The outlet portion 19 forms a part of the first valve slide 4*e*, second valve slide 4*f* or third valve slide 4*h*. When the inlet portion 17 is connected to the outlet portion 19, the column of air is prolonged.

The solenoid-operated valve actuator 22 is provided inside the valve casing 11, and is unmovable with respect to the valve casing 11. The solenoid-operated valve actuator 22 has a solenoid 24, and the rod 21 passes through the solenoid 24 in a direction parallel to the centerline of the valve casing 11, and projects from a lid 11A of the valve casing 11. The pressure sensor 23 is secured to the top surface of the finger button 15. The pressure sensor 23 and solenoid 24 are connected to the controlling unit 25.

The controlling unit 25 is fitted to a side surface of the trumpet, and includes a signal input circuit 25*a*, a power source and current driver 25*b* and a logic circuit 25*c*. In this instance, a storage battery is used as the power source. The pressure sensors 23 are connected to the signal input circuit 25*a*, and the detecting signals S1 are supplied to the signal input circuit 25*a*. The detecting signals S1 are amplified, and the waveform is shaped in the signal input signal 25*a*. The signal input circuit 25*a* is connected to the logic circuit 25*c*. A power switch 25*d* is provided on a casing of the controlling unit 25, and an enable signal is changed between an active level and an inactive level with the power switch 25*d*. The logic circuit 25*c* is enabled with the enable signal from the power switch 25*d*, and carries out logical operations on the output signals of the signal input circuit 25*a* so as to determine what solenoid-operated valve actuator or actuators 22 are to be driven with the driving signal or signals S2.

Electric current is generated in stable in the power source and current driver 25*b*. The power source and current driver 25*b* is responsive to the output signals of the logic circuit 25*c* so as to supply the driving signal S2 or signals to the solenoid-operated valve actuator or actuators 22.

The inlet portion 17 and outlet portions 18/19 are connected to an inlet port and outlet ports of the valve casing 11, and the valve 12 is formed with air passages 12A and 12B. The outlet portion 18 is confronted with the inlet portion 17, and the other outlet portion 19 is offset from the inlet portion 17 in the direction parallel to the centerline of the valve casing 11. The air passages 12A obliquely extends with respect to the centerline of the valve 12, and the other air passage 12B extends across the centerline at right angle.

Since the return spring 13 urges the valve 12 toward the solenoid-operated valve actuator 22, the valve 12 stay at a rest position in the absence of electric current flowing through the solenoid 24, and the inlet portion 17 is connected to the outlet portion 18 through the air passage 12B. However, the other air passage 12A is closed with the inner surface of the valve casing 11.

Figure 3:
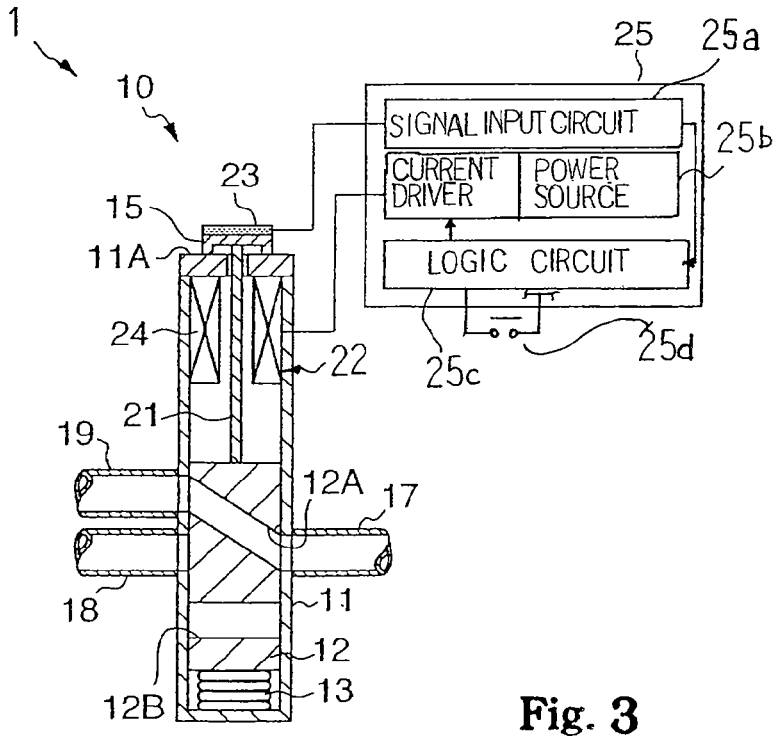
FIG. 3 is a schematic cross sectional view showing the valve actuator and associated valve in open state.

On the other hand, while the electric current flows through the solenoid 24, the magnetic force is exerted on the valve 12, and the valve 12 is moved toward the bottom portion of the valve casing 11, i.e., an end position against the elastic force of the return spring 13 as shown in FIG. 3. As a result, the inlet portion 17 is connected to the outlet portion 19 through the air passage 12A, and the other air passage 12B is closed with the inner surface of the valve casing 11.

Any magnetic force is not exerted on the valve 12 in the absence of the driving signal S2 so that an adult player depresses the finger buttons 15 against the return springs 13. In other words, the adult players can enjoy the trumpet 2 without the assistance of supporting system 1.

Figure 4:
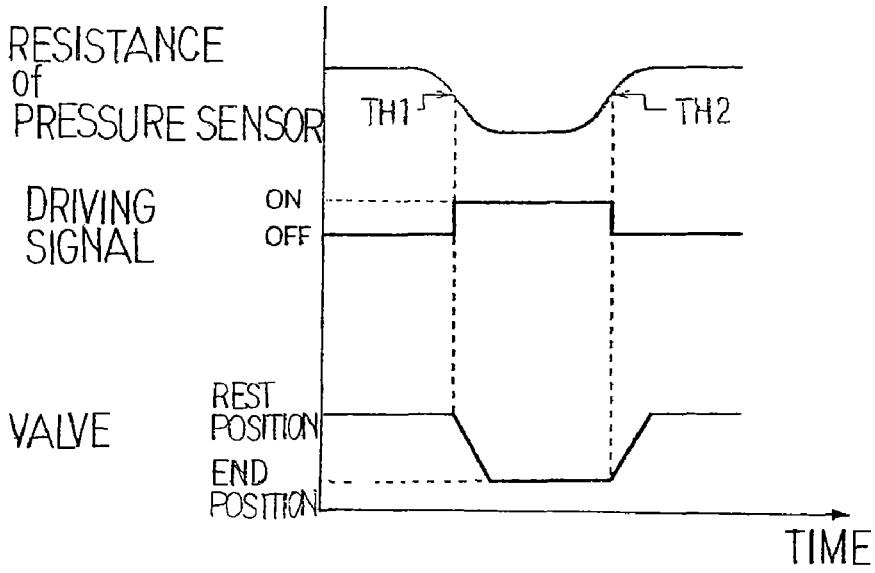
FIG. 4 is a timing chart showing the behavior of the supporting system.

Assuming now that a player depresses the power switch 25*d*, the logic circuit 25*c* is enabled with the enable signal supplied from the power switch 25*d*. The player begins the buzzing on the mouthpiece 3, and gives rise to the vibrations of the column of air. The tones are produced through the vibrations of the column of air, and the pitch of tones is varied depending upon the pressure of the breath. In this situation, the return springs 13 keep the valves 12 at the rest positions, and all of the first, second and third valve slides 4*e*/4*f*/4*h* are isolated from the tuning slide 4*c*. In other words, the column of air is not prolonged, and the pitch of tones is controlled through the breathing When the player changes the pitch of tones by using the first valve slide 4*e*, second valve slide 4*f* and/or third valve slide 4*h*, the player increases the force exerted on the finger button or buttons 15 so as to reduce the resistance of the pressure sensor or sensors 23. The potential level of the detecting signal or signals S1 is decayed inversely to the force. When the resistance is decayed below a certain value TH1 as shown in FIG. 4, the potential level of the detecting signal rises over a threshold of the logic circuit 25*c*, and the logic circuit 25*c* changes the output signal or signals thereof to the active level, and causes the driving signal S2 selectively to be supplied from the power source and current driver 25*b* to the solenoid-operated valve actuator or actuators 22. In other words, the driving signal or signals S2 is changed to the on-state as shown in FIG. 3.

While the driving signal is flowing the solenoid or solenoids 24, the magnetic field or fields are created, and the magnetic force is exerted on the valve or valves 12. The magnetic force gives rise to the movement of valve 12 or movements of valves 12 to the end position or positions against the elastic force of the return spring or springs 13. For this reason, the player feels the valve or valves 12 light.

When the player wishes to restore the tones to the previous pitch, the player removes the force from the pressure sensor or sensors 23. Then, the pressure sensor or sensors 23 increases the resistance. When the resistance exceeds a threshold TH2, the logic circuit 25*c* changes the output signal to the inactive level. Then, the power source and current driver 25*b* causes the driving signal to return to the off-state, and the magnetic force is removed from the valve or valves 12. As a result, the valve or valves 12 return to the rest position, and the first valve slide 4*e*, second valve slide 4*f* and/or third valve slide 4*h* is isolated from the tuning slide 4*c*. The column of air is shortened to the original length, and the tone or tones are restored to the previous pitch.

As will be understood from the foregoing description, the supporting system 1 partially removes the load from the player, and makes it easy to play the trumpet 1. Especially, child trainees, handicapped persons and old players appreciate the supporting system 1.

Since the controlling unit 25 is fitted to the trumpet 1, the supporting system 1 does not set any limit to the player.

Second Embodiment

Figure 5:
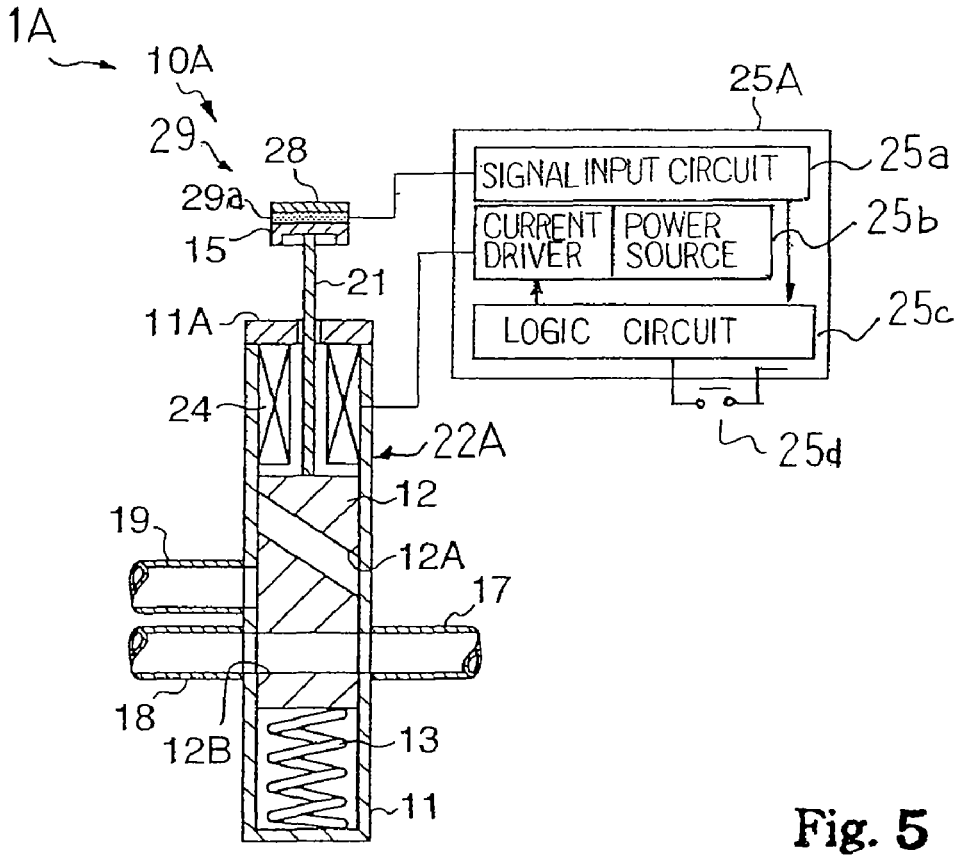
FIG. 5 is a schematic side view showing another supporting system of the present invention.

Turing to FIG. 5 of the drawings, another supporting system for a wind instrument includes valve assemblies 10A, a controlling unit 25A and pressure sensors 29. The valve assembly 10A and controlling unit 25A are same as the valve assembly 10 and controlling unit 25, respectively. For this reason, component parts of the valve assembly and controlling unit 10A/25A are labeled with the corresponding component parts 10/25 without detailed description for the sake of simplicity.

The pressure sensor 29 is different from the pressure sensor 23. The pressure sensor 29 includes a pressure-sensitive sheet 29*a* and a button 28. The pressure-sensitive sheet 29*a* is sandwiched between the finger button 15 and the button 28. The button 28 makes the force on the pressure-sensitive sheet 29*a* uniform. Even if a player concentrates the force to a narrow area of the button 28, the force is uniformly exerted on the pressure-sensitive sheet 29*a*. For this reason, the resistance of pressure-sensitive sheet varies together with the force regardless of the locality.

The supporting system 1A achieves all the advantages of the supporting system 1.

Third Embodiment

Figure 6:
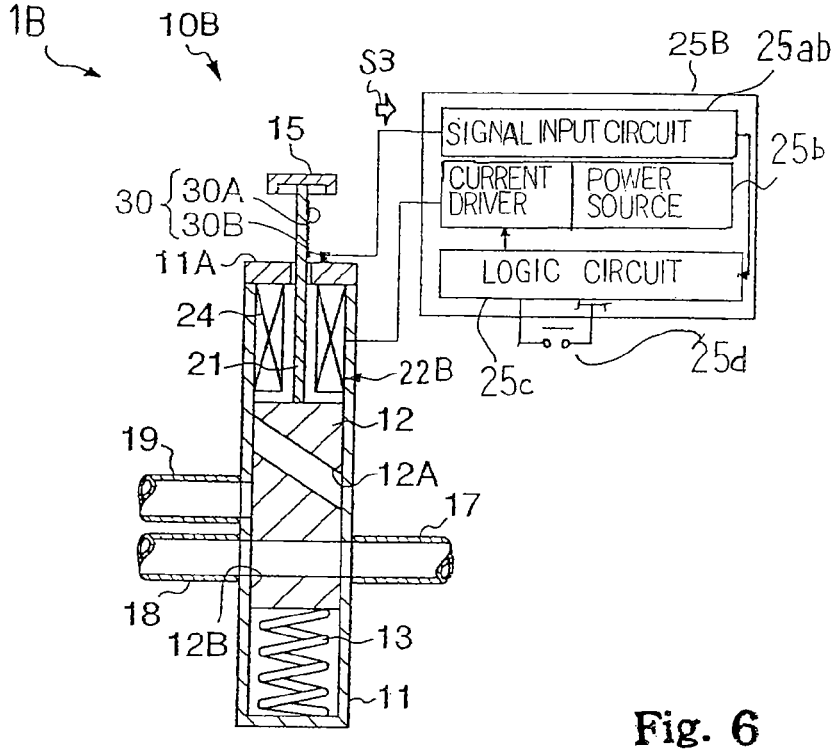
FIG. 6 is a schematic side view showing yet another supporting system of the present invention.

Turning to FIG. 6 of the drawings, yet another supporting system 1B embodying the present invention is combined with a wind musical instrument. The wind musical instrument includes at least one valve assembly 10B and a pipe structure, and the pipe structure includes the inlet portion 17 and outlet portions 18/19. Since the valve assembly 10B is similar in structure to the valve assembly 10, component parts of the valve assembly 10B are labeled with references designating the corresponding component parts of the valve assembly 10.

The supporting system 1B comprises at least one solenoid-operated valve actuator 22B, a controlling unit 25B and at least one sensor 30. The solenoid-operated valve actuator 22B and controlling unit 25B are similar in structure to the solenoid-operated valve actuator 22 and controlling unit 25 except for a signal input circuit 25*ab*, and, for this reason, component parts of the solenoid-operated valve actuator 22B and other components of the controlling unit 25B are labeled with the references designating the corresponding component parts of the solenoid-operated valve actuator 22 and components of the controlling unit 25 without detailed description.

The sensor 30 is implemented by a combination between a magnetic scale 30A and a magnetic sensor 30B. The magnetic scale 30A is adhered to the rod 21, and the magnetic sensor 30B is secured to the lid 11A. Pieces of positional data, which express the stroke of the rod 21 from the rest position, are magnetically written in the magnetic scale 30A, and the pieces of positional data are read by the magnetic sensor 30B. The magnetic sensor 30B converts the pieces of positional data to an electric signal S3, and the electric signal S3 is supplied from the magnetic sensor 30B to the signal input circuit 25*ab*. The signal input circuit 25*ab* includes an encoder (not shown), and the electric signal S3 is encoded to the distance over which the valve 12 travels. The encoded signal is compared with the thresholds TH1 and TH2, and the logic circuit 25*c* controls the power source and current driver 25*b* depending upon the result of the comparison.

The supporting system 1B behaves as similar to the supporting system 1, and achieves all the advantages of the supporting system 1.

Fourth Embodiment

Figure 7:
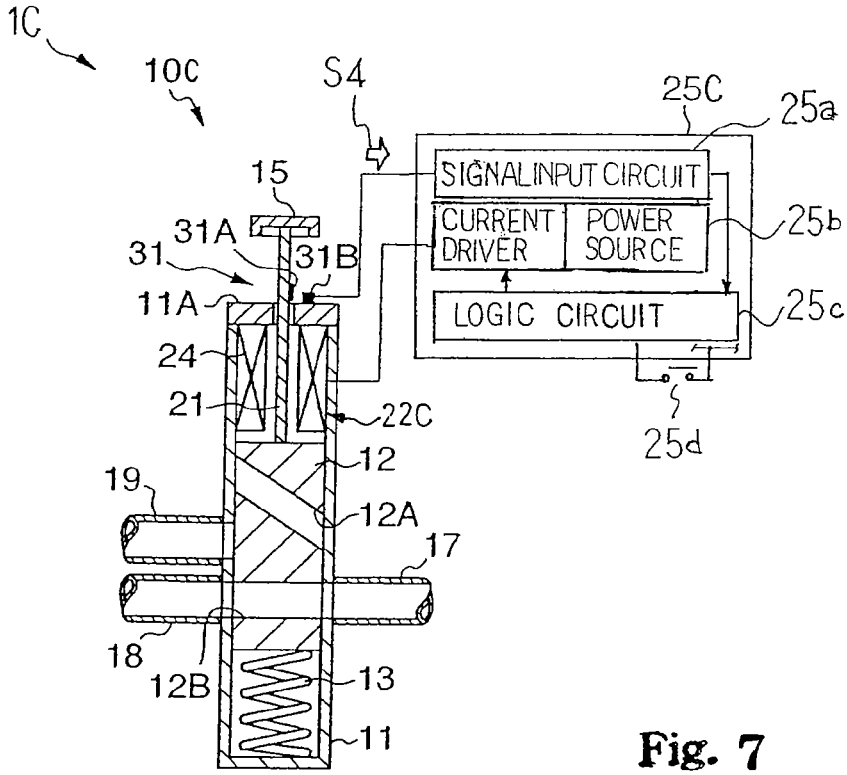
FIG. 7 is a schematic side view showing still another supporting system of the present invention.

Turning to FIG. 7 of the drawings, still another supporting system 1C embodying the present invention is combined with a wind musical instrument. The wind musical instrument includes at least one valve assembly 10C and a pipe structure, and the pipe structure includes the inlet portion 17 and outlet portions 18/19 as similar to the pipe structure 4. Since the valve assembly 10C is similar in structure to the valve assembly 10, component parts of the valve assembly 10C are labeled with references designating the corresponding component parts of the valve assembly 10.

The supporting system 1C comprises at least one solenoid-operated valve actuator 22C, a controlling unit 25C and at least one sensor 31. The solenoid-operated valve actuator 22C and controlling unit 25C are similar in structure to the solenoid-operated valve actuator 22 and controlling unit 25, and, for this reason, component parts of the solenoid-operated valve actuator 22C and components of the controlling unit 25C are labeled with the references designating the corresponding component parts of the solenoid-operated valve actuator 22 and components of the controlling unit 25 without detailed description.

The sensor 31 is implemented by a combination between a piece of magnet 31A and an electromagnetic pickup 31B. The piece of magnet 31A is fixed to the rod 21, and the electromagnetic pickup 31B is fitted to the lip 11A. The electromagnetic pickup 31B has a coil, and the coil converts velocity of the piece of magnet 31A to a detecting signal S4. When a player pushes down the finger button 15, the piece of magnet 31A is moved together with the rod 21, and the moving piece of magnet 31A gives rise to electric current S4 in the electromagnetic pickup 31B. The current flows into the signal input circuit 25*a* so that the logic circuit 25*c* acknowledges that the player pushes down the finger button 15. Then, the logic circuit 25*c* requests the solenoid-operated valve actuator 22C to assist the player. Since the piece of magnet 31A stops at the end position of the valve 12, the logic circuit 25*c* acknowledges that the valve 12 reaches the end position. Although the piece of magnet 31A gives rise to current on the way from the end position to the rest position, the logic circuit 25*c* ignores it, and any magnetic force is not exerted on the valve 12 moved from the end position to the rest position.

The supporting system 1C behaves as similar to the supporting system 1, and achieves all the advantages of the supporting system 1.

Fifth Embodiment

Figure 8:
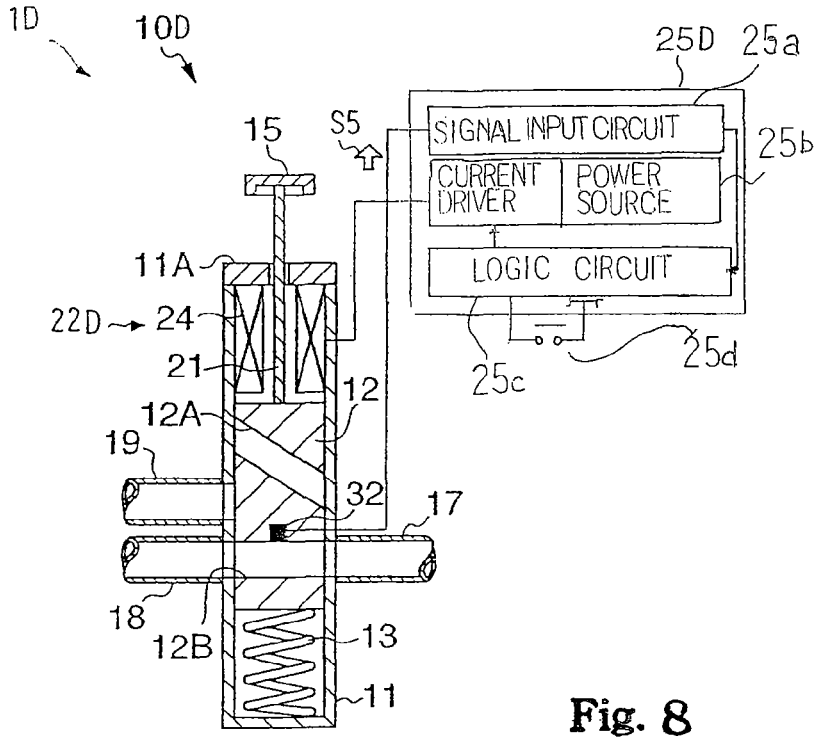
FIG. 8 is a schematic side view showing yet another supporting system of the present invention.

Turning to FIG. 8 of the drawings, yet another supporting system 1D embodying the present invention is combined with a wind musical instrument. The wind musical instrument includes at least one valve assembly 10D and a pipe structure, and the pipe structure includes the inlet portion 17 and outlet portions 18/19 as similar to the pipe structure 4. Since the valve assembly 10D is similar in structure to the valve assembly 10, component parts of the valve assembly 10D are labeled with references designating the corresponding component parts of the valve assembly 10.

The supporting system 1D comprises at least one solenoid-operated valve actuator 22D, a controlling unit 25D and at least one sensor 32. The solenoid-operated valve actuator 22D and controlling unit 25D are similar in structure to the solenoid-operated valve actuator 22 and controlling unit 25, and, for this reason, component parts of the solenoid-operated valve actuator 22D and components of the controlling unit 25D are labeled with the references designating the corresponding component parts of the solenoid-operated valve actuator 22 and components of the controlling unit 25 without detailed description.

A triaxial acceleration sensor serves as the sensor 32, and has piezoelectric elements for converting force, i.e., acceleration to an electric signal S5. The sensor 32 is embedded in the valve 12, and, accordingly, is moved together with the valve 32. While the valve 12 is staying at the end position and rest position, any acceleration is exerted on the sensor 32. When a player presses down the finger button 15, the acceleration is exerted on the sensor 32, and the sensor 32 causes the potential level of electric signal S5 to rise. Then, the logic circuit 25*c* requests the power source and current driver 25*b* to assist the player.

The supporting system 1D behaves as similar to the supporting system 1, and achieves all the advantages of the supporting system 1.

Sixth Embodiment

Figure 9:
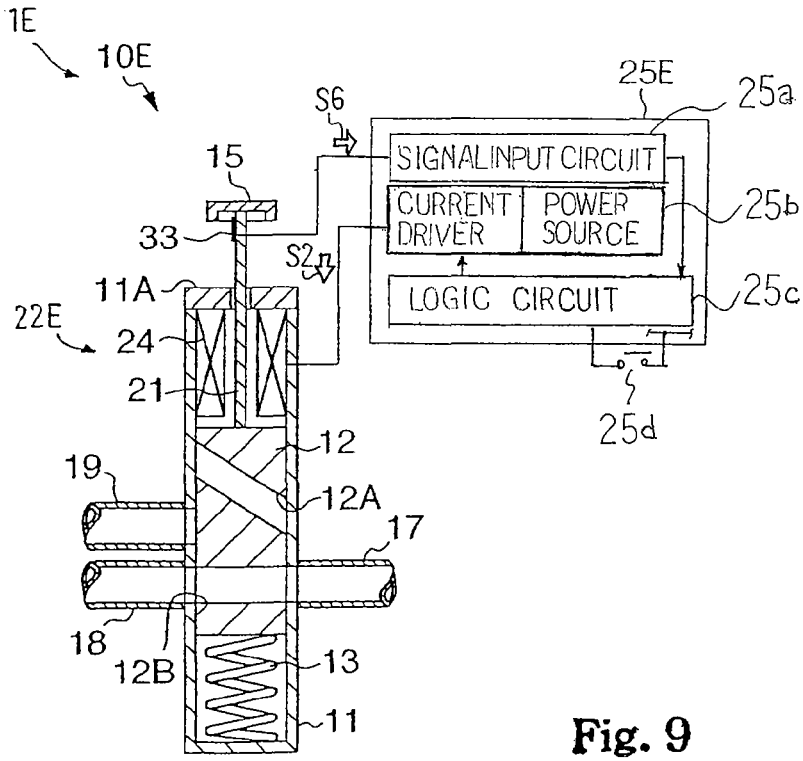
FIG. 9 is a schematic side view showing still another supporting system of the present invention.

Turning to FIG. 9 of the drawings, still another supporting system 1E embodying the present invention is combined with a wind musical instrument. The wind musical instrument includes at least one valve assembly 10E and a pipe structure, and the pipe structure includes the inlet portion 17 and outlet portions 18/19 as similar to the pipe structure 4. Since the valve assembly 10E is similar in structure to the valve assembly 10, component parts of the valve assembly 10E are labeled with references designating the corresponding component parts of the valve assembly 10.

The supporting system 1E comprises at least one solenoid-operated valve actuator 22E, a controlling unit 25E and at least one sensor 33. The solenoid-operated valve actuator 22E and controlling unit 25E are similar in structure to the solenoid-operated valve actuator 22 and controlling unit 25, and, for this reason, component parts of the solenoid-operated valve actuator 22E and components of the controlling unit 25E are labeled with the references designating the corresponding component parts of the solenoid-operated valve actuator 22 and components of the controlling unit 25 without detailed description.

The sensor 33 is implemented by a strain gauge, and is fitted to the rod 21. While a player is exerting force on the finger button 15, the force gives rise to deformation of the rod 21, and the strain gauge 33 starts to supply an electric signal S5 to the controlling unit 25E. With the electric signal S6 over the threshold TH1, the logic circuit 25*c* requests the power source and current driver 25*b* to supply the driving signal S2 to the solenoid-operated valve actuator 22E. While the return spring 13 is pushing the valve 12 toward the rest position, any force is not exerted on the strain gauge 33. Thus, the sensor 33 raises and keeps the electric signal S6 while the solenoid-operated valve actuator 22E is to assist the player. For this reason, the logic circuit 25*c* of the controlling unit 25E is simpler than the logic circuits 25*c* of the controlling circuits 25B, 25C and 25D are.

The supporting system 1E behaves as similar to the supporting system 1, and achieves all the advantages of the supporting system 1.

Seventh Embodiment

Figure 10:
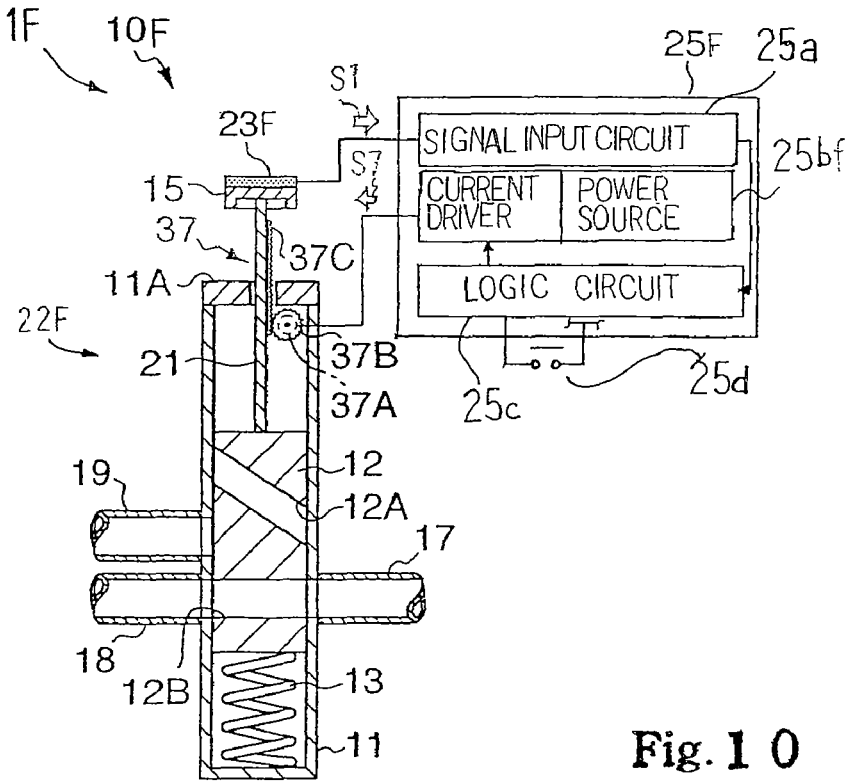
FIG. 10 is a schematic side view showing yet another supporting system of the present invention.

Turning to FIG. 10 of the drawings, yet another supporting system 1F embodying the present invention is combined with a wind musical instrument. The wind musical instrument includes at least one valve assembly 10F and a pipe structure, and the pipe structure includes the inlet portion 17 and outlet portions 18/19 as similar to the pipe structure 4. Since the valve assembly 10F is similar in structure to the valve assembly 10, component parts of the valve assembly 10F are labeled with references designating the corresponding component parts of the valve assembly 10.

The supporting system 1F comprises at least one valve actuator 22F, a controlling unit 25F and at least one sensor 23F. The sensor 23F and controlling unit 25F are similar in structure to the sensor 23 and controlling unit 25 except for a power source and current driver 25*bf*, and, for this reason, components of the controlling unit 25F are labeled with the references designating the corresponding component parts of the solenoid-operated valve actuator 22 and components of the controlling unit 25. The power source and current driver 25*bf* includes a changeover circuit so that the polarity of a driving signal S7 is inverted.

The valve driver 22F is implemented by a combination of an ultrasonic motor 37A, a pinion 37B and a rack 37C. The ultrasonic motor 37A is housed in the valve casing 11, and is connected to the power source and current driver 25*b* of the controlling unit 25F. The ultrasonic motor 37A is of the type to keep the output shaft in the absence of the electric power. The pinion 37B is connected to the output shaft of the ultrasonic motor 37A so that the ultrasonic motor 37A bidirectionally drives the pinion 37B for rotation. The rack 37C is secured to the rod 21, and extends in the direction parallel to the centerline of the rod 21. The pinion 37B is held in threaded engagement with the rack 37C so that the pinion 37B and rack 37C convert the rotation of output shaft of the ultrasonic motor 37A to the linear movement of the rod 21.

Figure 11:
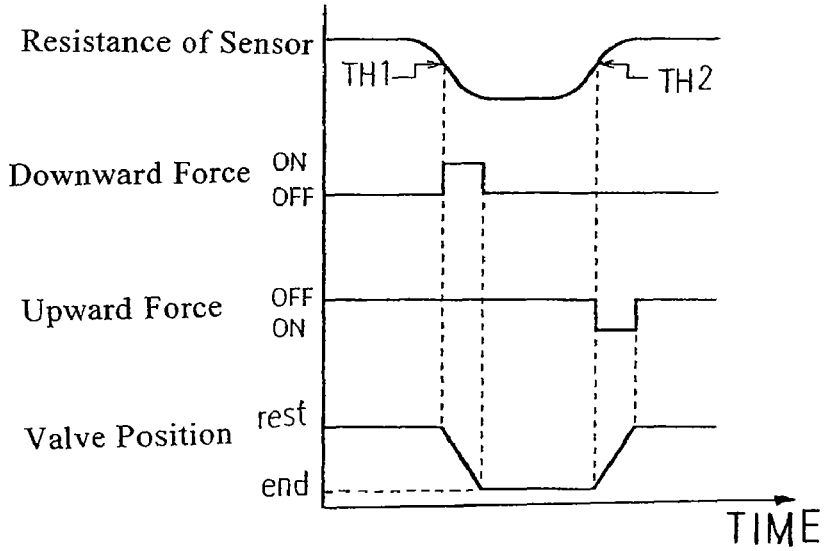
FIG. 11 is a timing chart showing the behavior of the supporting system shown in FIG. 10.

Description is made on the behavior of the supporting system 25F with reference to FIG. 11. A player is assumed to play a music passage on the wind musical instrument with the assistance of the supporting system 1F. When the player wishes to change the pitch of tone without changing the buzzing, he or she exerts force on the finger button 15, and the force makes the sensor 23F decrease the resistance against the detecting signal S1. When the resistance is decayed below the certain value TH1, the power source and current driver 25*bf* applies the electric power to the ultrasonic motor 37A in such a manner that the pinion 37B and rack 37C cause the rod 21 and valve 12 to be moved toward the bottom portion of the valve casing 11. In other words, the downward force is exerted on the valve 12 against the elastic force of the return spring 13. When the valve 12 reaches the end position, the electric power is removed from the ultrasonic motor 37A, and prevents the output shaft from inverse rotation. Then, the inlet portion 17 is connected to the outlet portion 19 through the air passage 12A, and the pitch of tone or tones is changed.

When the player wishes to restore the pitch of tone or tones, he or she removes the force from the finger button 15, and makes the sensor 23F increase the resistance. When the resistance exceeds the value TH2, the logic circuit 25*c* causes the changeover circuit inversely to apply the potential to the ultrasonic motor 37A so that the ultrasonic motor 37A, pinion 37B and rack 37C exert upward force to the valve 13. The upward force is removed from the valve 12 at the rest position, and the ultrasonic motor 37A keeps the valve 12 at the rest position.

Thus, the supporting system 1F behaves as similar to the supporting system 1, and achieves all the advantages of the supporting system 1.

Eighth Embodiment

Figure 12:
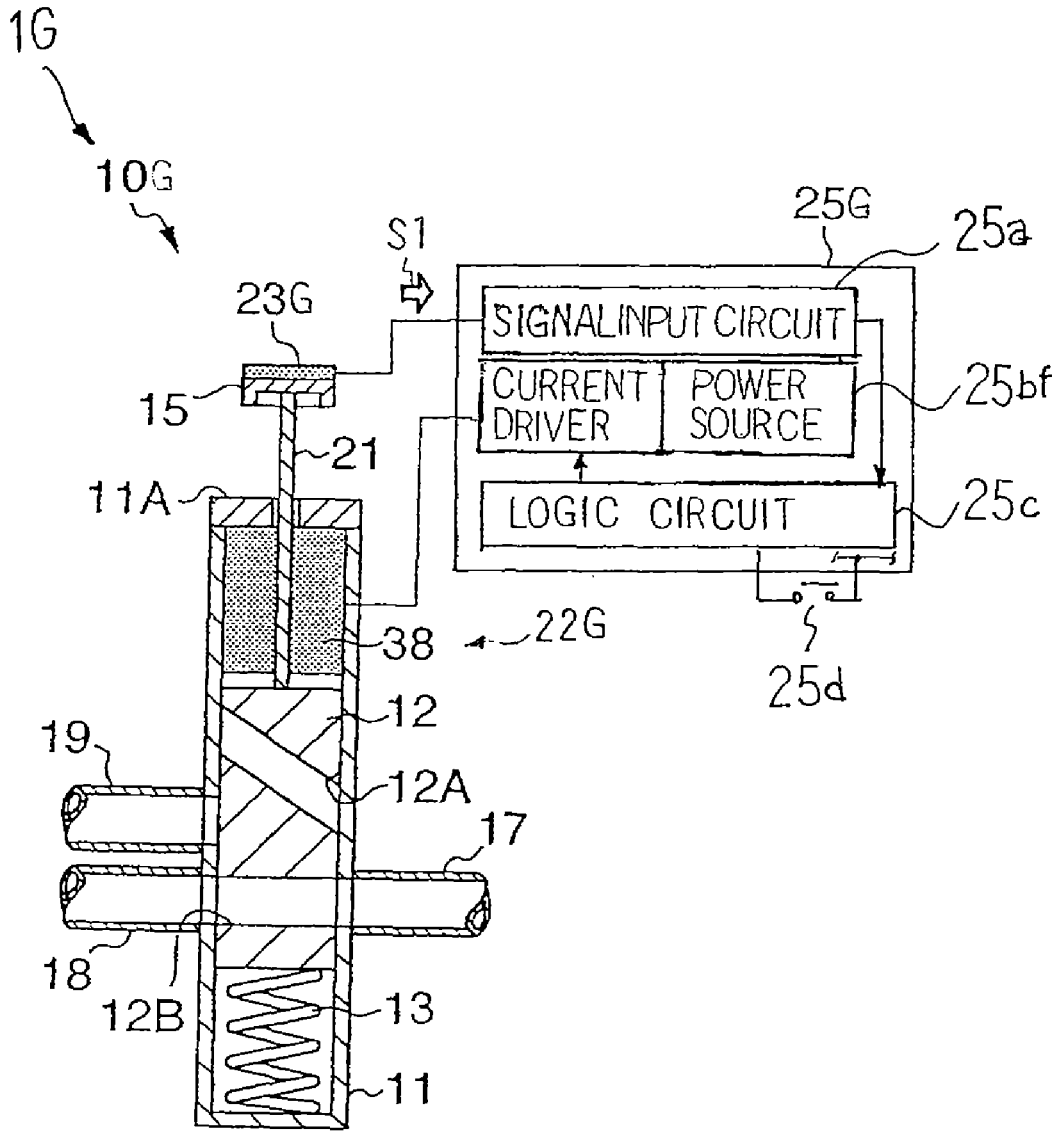
FIG. 12 is a schematic side view showing still another supporting system of the present invention.
Figure 1:
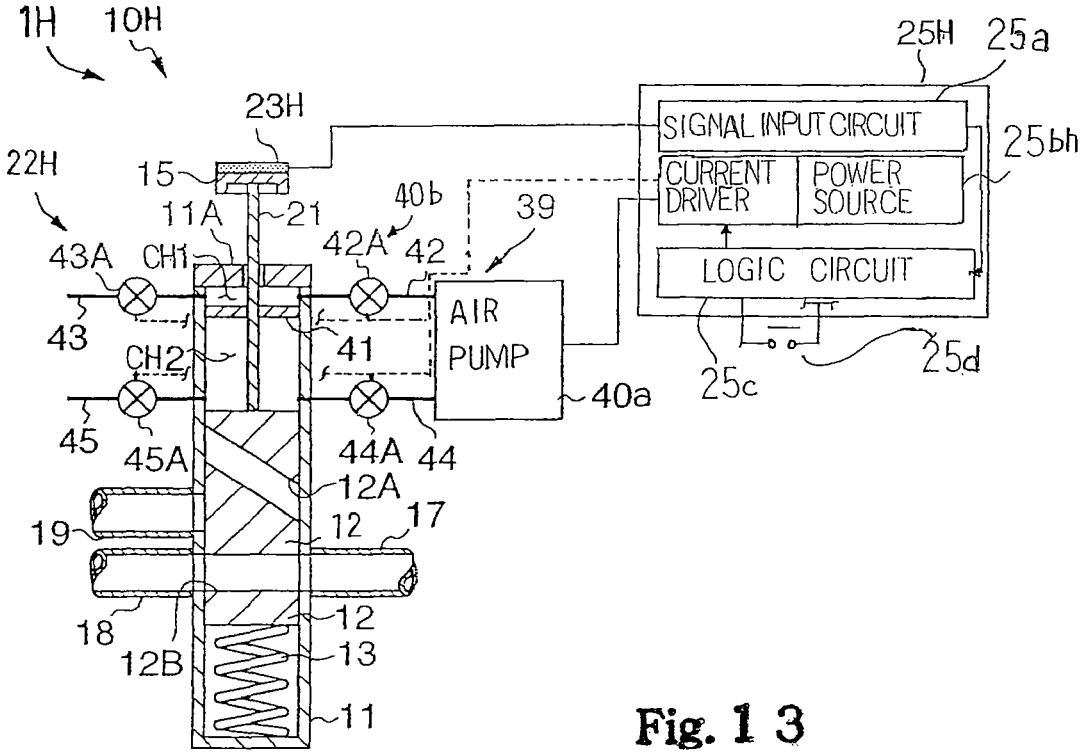
Figure 1:
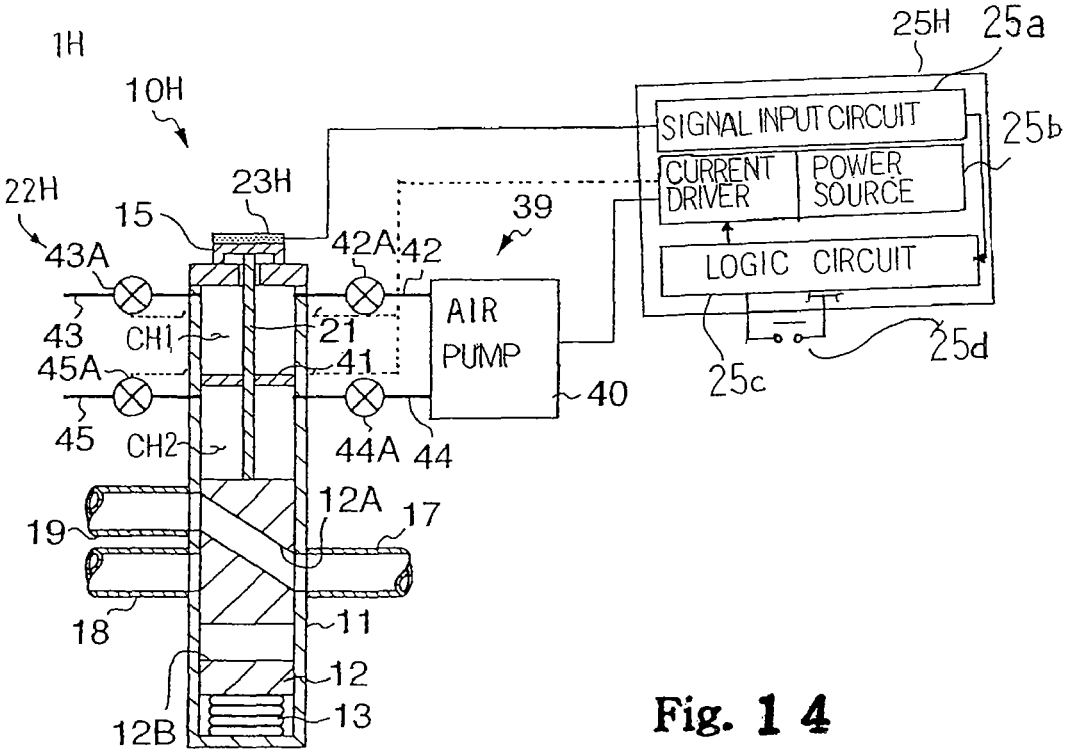

Turning to FIG. 12 of the drawings, still another supporting system 1G embodying the present invention is combined with a wind musical instrument. The wind musical instrument includes at least one valve assembly 10G and a pipe structure, and the pipe structure includes the inlet portion 17 and outlet portions 18/19 as similar to the pipe structure 4. Since the valve assembly 10G is similar in structure to the valve assembly 10, component parts of the valve assembly 10G are labeled with references designating the corresponding component parts of the valve assembly 10.

The supporting system 1G comprises at least one valve actuator 22G, a controlling unit 25G and at least one sensor 23G. The sensor 23G and controlling unit 25G are similar in structure to the sensor 23 and controlling unit 25 except for the power source and current driver 25*bf*, and, for this reason, components of the controlling unit 25G are labeled with the references designating the corresponding components of the controlling unit 25. The power source and current driver 25*bf* includes a changeover circuit so that the polarity of driving signal S8 is inverted.

The valve driver 22G is implemented by a surface acoustic wave motor 38. The surface acoustic wave motor 38 is provided around the rod 21 inside the valve casing 11, and is connected to the power source and current driver 25*bf*. With the electric power supplied from the power source and current driver 25*bf*, the surface acoustic wave motor 38 gives rise to the bidirectional movement of the rod 21, i.e., the downward movement and upward movement.

The supporting system 1G behaves as similar to the supporting system 1, and achieves all the advantages of the supporting system 1.

Ninth Embodiment

Turning to FIG. 13 of the drawings, yet another supporting system 1H embodying the present invention is combined with a wind musical instrument. The wind musical instrument includes at least one valve assembly 10H and a pipe structure, and the pipe structure includes the inlet portion 17 and outlet portions 18/19 as similar to the pipe structure 4. Since the valve assembly 10H is similar in structure to the valve assembly 10, component parts of the valve assembly 10H are labeled with references designating the corresponding component parts of the valve assembly 10.

The supporting system 1H comprises at least one valve actuator 22H, a controlling unit 25H and at least one sensor 23H. The sensor 23H and controlling unit 25H are similar in structure to the sensor 23 and controlling unit 25 except for a power source and current driver 25*bh*, and, for this reason, other components of the controlling unit 25H are labeled with the references designating the corresponding components of the controlling unit 25. The power source and current driver 25*bh* has terminals for a pneumatic control system as will be described hereinafter.

The valve driver 22H is implemented by a pneumatic system 39. The pneumatic system 39 includes an air pump 40*a*, a pneumatic actuator 40*b*, electromagnetic air supply valves 42A/44A, electromagnetic exhaust valves 43A/45A and air guide tubes 42/43/44/45. Though not shown in FIG. 13, a reservoir is provided in association with the air pump 40*a*, and the power source and current driver 25*bh* intermittently energizes the air pump 40*a* depending upon the air pressure in the reservoir.

The valve casing 11 is shared between the valve 12 and the pneumatic actuator 40*b*. A piston 41 of the pneumatic actuator 40*b* is movably housed in the valve casing 11, and two air chambers CH1 and CH2 are defined by the piston 41 in the valve casing 11. The air tube 42 is provided between the air pump 40*a* and the air chamber CH1, and the other air tube 43 is provided between the air chamber CH1 and the atmosphere. Similarly, the air tube 44 is provided between the air pump 40*a* and the air chamber CH2, and the other air tube 45 is provided between the air chamber CH2 and the atmosphere. The electromagnetic air supply valves 42A and 44A are respectively connected to the air tubes 42 and 44, and the other electromagnetic air exhaust valves 43A and 45A are respectively connected to the air tubes 43 and 45.

The power source and current driver 25*bh* causes the electromagnetic air supply valve 42A or 44A to turn on so that the high-pressure air is supplied from the reservoir to the air chamber CH1 or CH2. On the other hand, the electromagnetic air exhaust valve 45A or 43A is turned on, and the high-pressure air is exhausted from the other air chamber CH2 or CH1 to the atmosphere.

When a player depresses the finger button 15, the high-pressure air is supplied to the air chamber CH1, and the inlet portion 17 is connected to the outlet portion 19 through the air passage 12A as shown in FIG. 14. Thus, the pneumatic actuator assists the player.

On the other hand, when the player releases the finger button 15, the high-pressure air is supplied to the air chamber CH2, and rapidly makes the valve 12 to return the rest position. Thus, the supporting system 1H behaves as similar to the supporting system 1, and achieves all the advantages of the supporting system 1.

Tenth Embodiment

Figure 15:
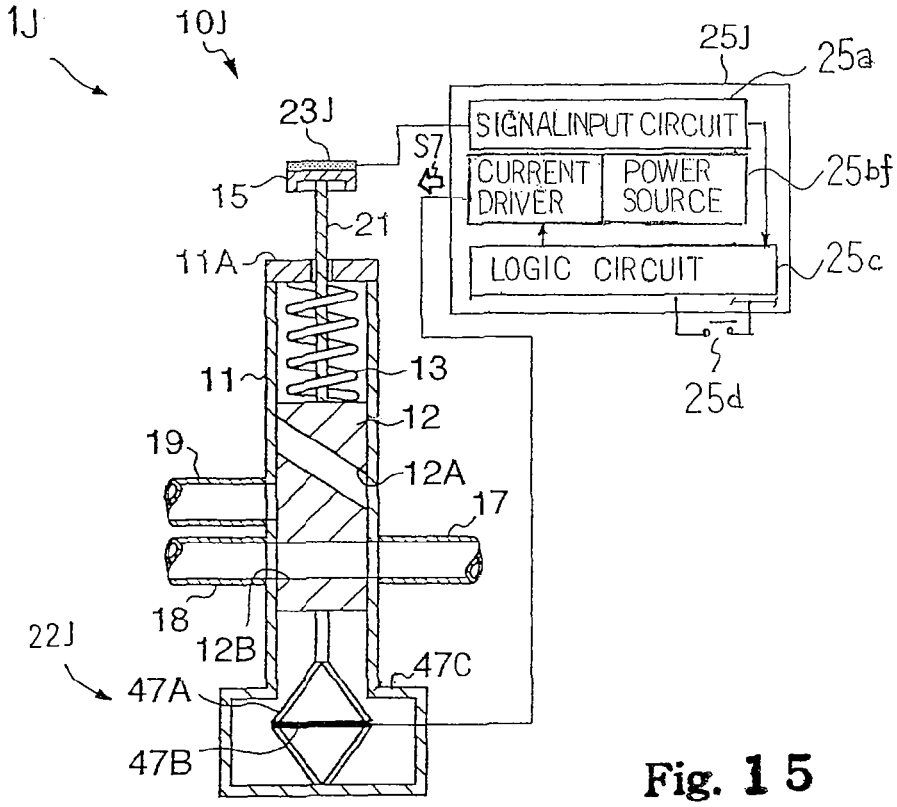
FIGS. 15 and 16 are schematic side views showing still another supporting system of the present invention at different valve positions.

Turning to FIG. 15 of the drawings, still another supporting system 1J embodying the present invention is combined with a wind musical instrument. The wind musical instrument includes at least one valve assembly 10J and a pipe structure, and the pipe structure includes the inlet portion 17 and outlet portions 18/19 as similar to the pipe structure 4. Since the valve assembly 10J is similar in structure to the valve assembly 10, component parts of the valve assembly 10J are labeled with references designating the corresponding component parts of the valve assembly 10.

The supporting system 1J comprises at least one valve actuator 22J, a controlling unit 25J and at least one sensor 23J. The sensor 23J and controlling unit 25J are similar in structure to the sensor 23 and controlling unit 25F, and, for this reason, components of the controlling unit 25J are labeled with the references designating the corresponding components of the controlling unit 25F.

The valve actuator 22*j* is implemented by a combination of a pantograph 47A and a polymer actuator 47B. A mechanic chamber 47C is continued to the lower portion of the valve casing 11, and the pantograph 47A is connected between the bottom portion of the mechanic chamber 47C and the lower portion of the valve 12. A sheet of EAP (Electric Actuating Polymer) is used as the polymer actuator 47B, and is connected at both ends to the joints between the upper links and the lower links of the pantograph 47A. The power source and current driver 25*bf* is connected to both surfaces of the sheet of EAP.

Figure 16:
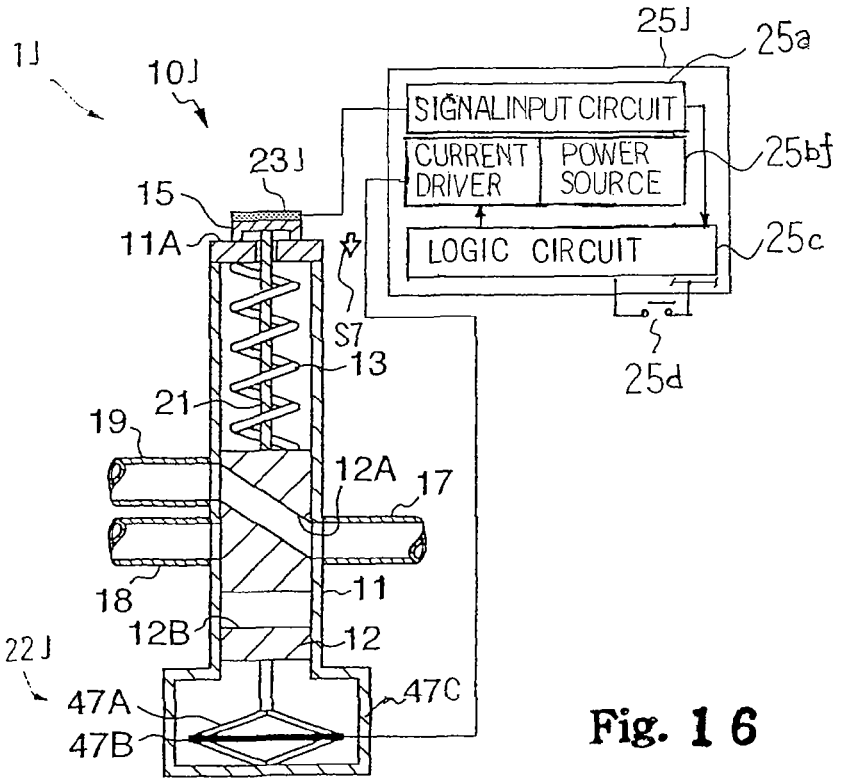

When a player wishes to change the pitch of tone or tones, he or she depresses the finger button 15. Then, the logic circuit 25*c* makes the power source and current driver 25*bf* invert the polarity of the driving signal S7, and the driving signal S7 gives rise to elongation of the sheet of EAP 47B as shown in FIG. 16. The angle between the upper links is increased, and, accordingly, the height of pantograph 47A is reduced. As a result, the valve 12 is pulled down against the elastic force of the return spring 13, which is connected between the lid 11A and the upper portion of the valve 12. The inlet portion 17 is connected to the outlet portion 19 through the air passage 12A, and the length of air column is changed.

When the player wishes to restore the tone or tones to the previous pitch, he or she releases the finger button 15. Then, the logic circuit 25*c* makes the power source and current driver 25*bf* change the driving signal S7 to the previous polarity. The driving signal S7 causes the sheet of EAP to be shrunk, and the return spring 13 pulls up the valve 12 so that the inlet portion 17 is connected to the outlet portion 18 through the air passage 12B as shown in FIG. 15. This results in the change in length of air column. Thus, the supporting system 1J behaves as similar to the supporting system 1, and achieves all the advantages of the supporting system 1.

Eleventh Embodiment

Figure 17:
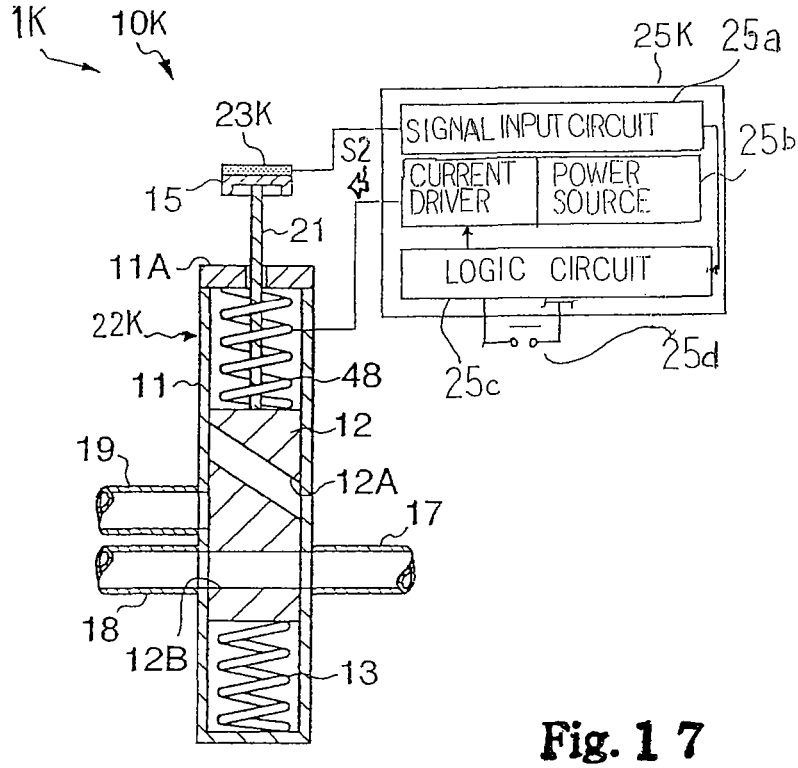
FIGS. 17 and 18 are schematic side views showing yet another supporting system of the present invention at different valve positions.

Turning to FIG. 17 of the drawings, yet another supporting system 1K embodying the present invention is combined with a wind musical instrument. The wind musical instrument includes at least one valve assembly 10K and a pipe structure, and the pipe structure includes the inlet portion 17 and outlet portions 18/19 as similar to the pipe structure 4. Since the valve assembly 10K is similar in structure to the valve assembly 10, component parts of the valve assembly 10K are labeled with references designating the corresponding component parts of the valve assembly 10.

The supporting system 1K comprises at least one valve actuator 22K, a controlling unit 25K and at least one sensor 23K. The sensor 23K and controlling unit 25K are similar in structure to the sensor 23 and controlling unit 25, and, for this reason, components of the controlling unit 25K are labeled with the references designating the corresponding components of the controlling unit 25.

The valve actuator 22K is implemented by a spiral member 48 of shape memory alloy. The spiral member 48 is wound around the rod 21 inside the valve casing 11, and is connected to the power source and current driver 25*b*.

When a player wishes to change the pitch of tone or tones, he or she depresses the finger button 15. Then, the logic circuit 25*c* makes the power source and current driver 25*b* supply the driving signal S2 to the spiral member 48, and the driving signal S2 gives rise to elongation of the spiral member 48. As a result, the valve 12 is pushed down against the elastic force of the return spring 13. The inlet portion 17 is connected to the outlet portion 19 through the air passage 12A, and the length of air column is changed.

When the player wishes to restore the tone or tones to the previous pitch, he or she releases the finger button 15. Then, the logic circuit 25*c* makes the power source and current driver 25*b* stop the driving signal S2. The spiral member 48 is shrunk, and the return spring 13 pushes up the valve 12 so that the inlet portion 17 is connected to the outlet portion 18 through the air passage 12B. This results in the change in length of air column. Thus, the supporting system 1K behaves as similar to the supporting system 1, and achieves all the advantages of the supporting system 1.

Twelfth Embodiment

Figure 18:
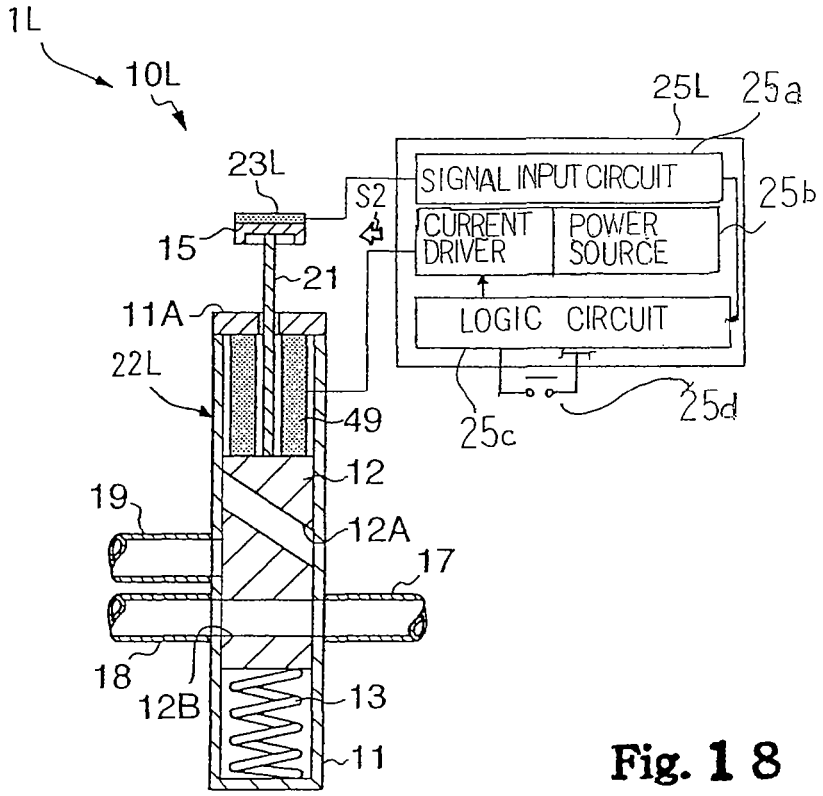

Turning to FIG. 18 of the drawings, still another supporting system 1L embodying the present invention is combined with a wind musical instrument. The wind musical instrument includes at least one valve assembly 10L and a pipe structure, and the pipe structure includes the inlet portion 17 and outlet portions 18/19 as similar to the pipe structure 4. Since the valve assembly 10L is similar in structure to the valve assembly 10, component parts of the valve assembly 10L are labeled with references designating the corresponding component parts of the valve assembly 10.

The supporting system 1L comprises at least one valve actuator 22L, a controlling unit 25L and at least one sensor 23L. The sensor 23L and controlling unit 25L are similar in structure to the sensor 23 and controlling unit 25, and, for this reason, components of the controlling unit 25L are labeled with the references designating the corresponding components of the controlling unit 25.

The valve actuator 22K is implemented by a piezoelectric element 49. The piezoelectric element 49 is provided between the lid 11A and the valve 12 inside the valve casing 11, and is connected to the power source and current driver 25*b*.

When a player wishes to change the pitch of tone or tones, he or she depresses the finger button 15. Then, the logic circuit 25*c* makes the power source and current driver 25*b* supply the driving signal S2 to the piezoelectric element 49, and the driving signal S2 gives rise to elongation of the piezoelectric element 49. As a result, the valve 12 is pushed down against the elastic force of the return spring 13. The inlet portion 17 is connected to the outlet portion 19 through the air passage 12A, and the length of air column is changed.

When the player wishes to restore the tone or tones to the previous pitch, he or she releases the finger button 15. Then, the logic circuit 25*c* makes the power source and current driver 25*b* stop the driving signal S2. The piezoelectric element is shrunk, and the return spring 13 pushes up the valve 12 so that the inlet portion 17 is connected to the outlet portion 18 through the air passage 12B. This results in the change in length of air column. Thus, the supporting system 1K behaves as similar to the supporting system 1, and achieves all the advantages of the supporting system 1.

Thirteenth Embodiment

Figure 19:
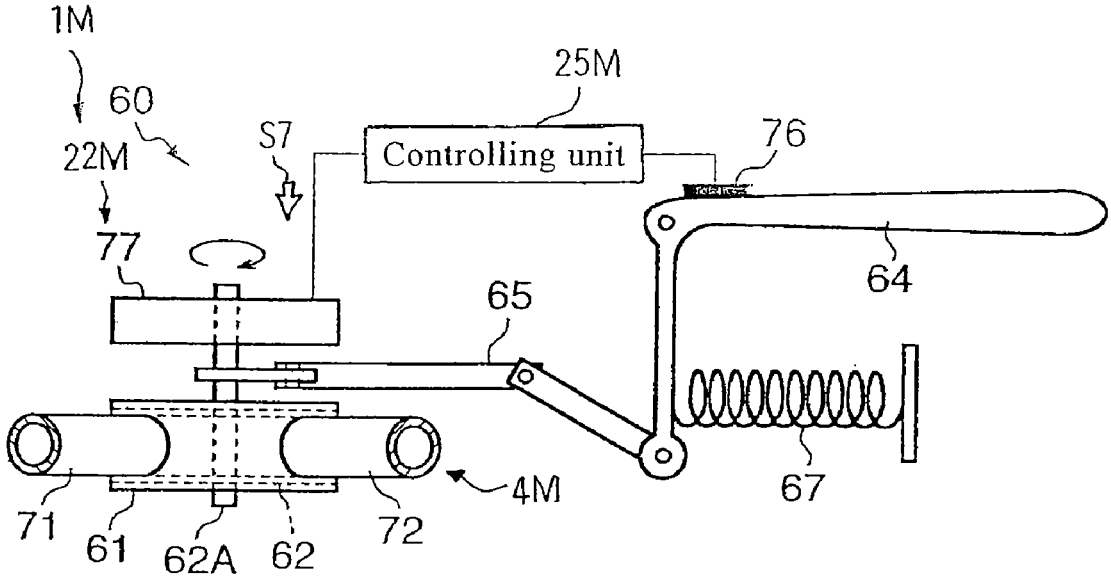
FIG. 19 is a front view showing a supporting system combined with a wind instrument with rotary valve assemblies.
Figure 20:
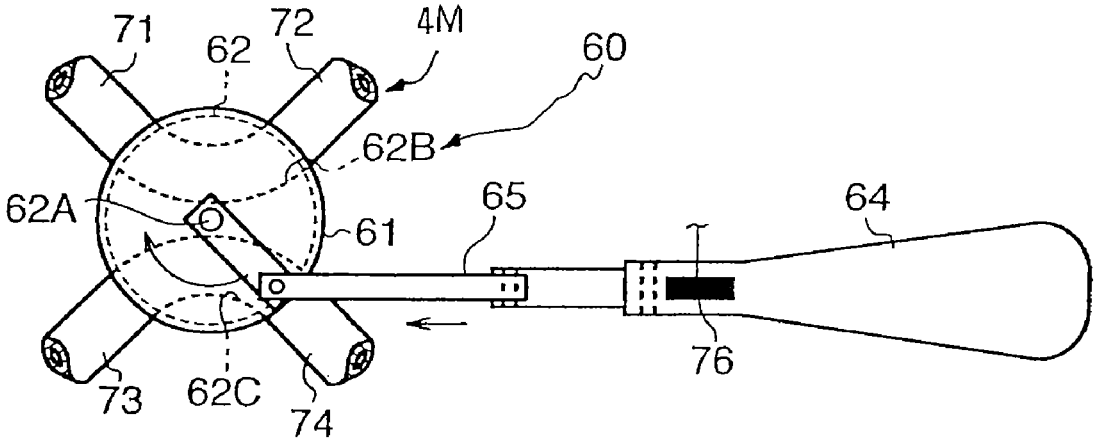
FIG. 20 is a plane view showing the supporting system.

Turning to FIGS. 19 and 20 of the drawings, yet another supporting system 1M embodying the present invention is combined with a wind musical instrument. The wind musical instrument is of the type having rotary valves such as, for example, a French horn, a rotary trumpet or a rotary tuba, and has a mouth piece (not shown), a pipe structure 4M, rotary valve assemblies 60. keys 64, links 65 and a return spring 67. Reference numerals 71, 72, 73 and 74 designate connecting portions of the pipe structure 4M.

The rotary valve assembly 60 has a valve casing 61 formed with four ports, a valve body 62 and a shaft 62A. The four ports of the valve casing 61 are connected to the connecting portions 71, 72, 73 and 74 of the pipe structure 4M, respectively, and the valve body 62 is housed in the valve casing 61. The shaft 62C projects from the valve body 62, and extends outside of the valve casing 61. The shaft 62C is rotatably supported by the valve casing so that the valve body 62 is bi-directionally rotatable between a first valve position and a second valve position in the valve casing 61. Two air passages 62B and 62C are formed in the valve body 62, and are selectively connected to the connecting portions 72, 73, 74 and 75.

Figure 21:
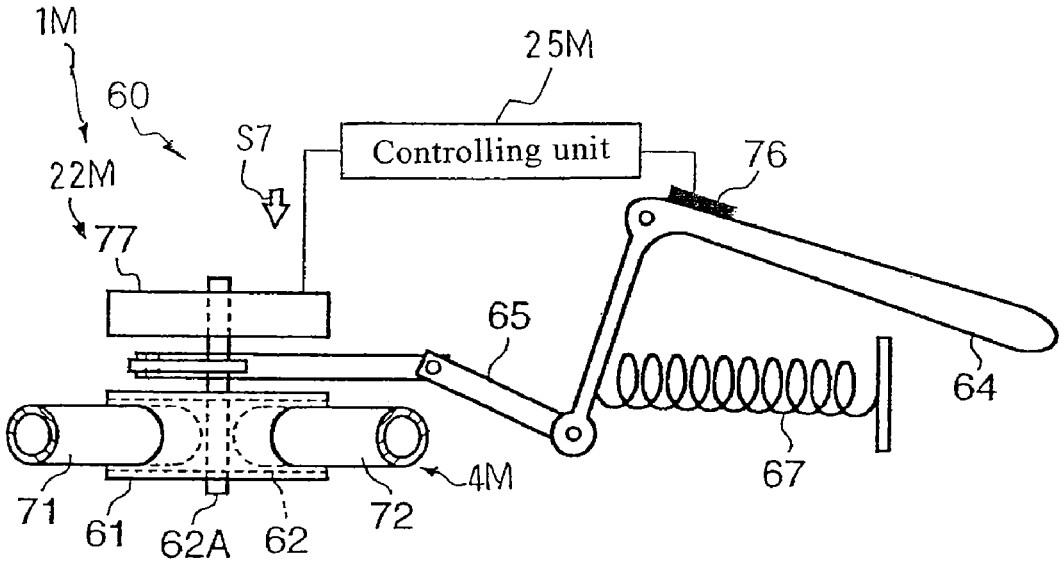
FIG. 21 is a front view showing the supporting system at a different valve position.
Figure 22:
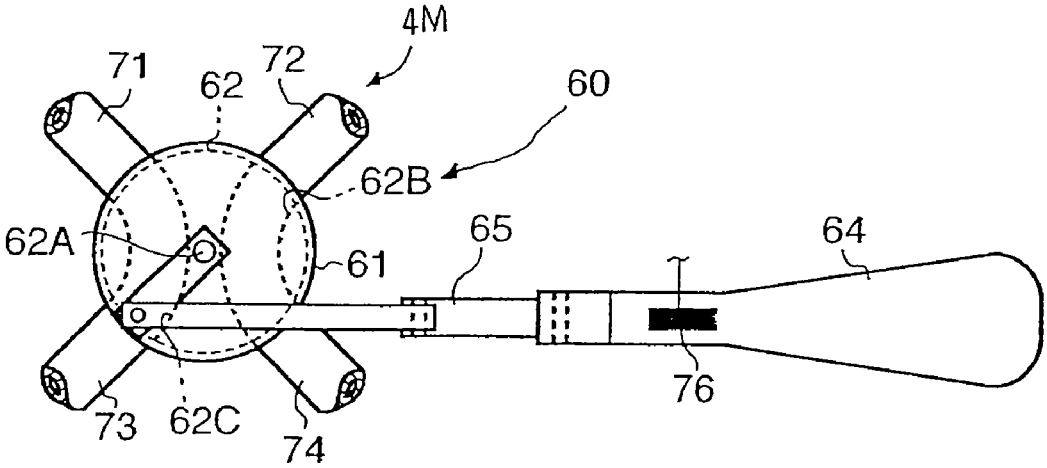
FIG. 22 is a plane view showing the supporting system at the different valve position.

When the rotary valve assembly 60 is staying at the first valve position, the connecting portion 71 is connected to the connecting portion 72 through the air passage 62B, and the connecting portion 73 is connected to the connecting portion 74 through the air passage 62C. On the other hand, when the rotary valve assembly 60 is changed from the first valve portion to the second valve position as shown in FIGS. 21 and 22, the connecting portion 71 is connected to the connecting portion 73 through the air passage 62C, and the connecting portion 72 is connected to the connecting portion 74 through the air passage 62B.

A player changes the rotary valve assembly 60 between the first valve position and the second valve position by means of the key 64. While the key 64 is free from force exerted thereon by the player, the rotary valve assembly 60 stays at the first valve position. When the player changes the rotary valve assembly 60 to the second valve position, he or she depresses the key 64 against the elastic force of the return spring 67, the links 65 convert the rotation of the key 64 to rotation of shaft 62A, and the rotary valve assembly 60 is changed to the second valve position.

The supporting system 1M comprises at least one valve actuator 22M, a controlling unit 25M and at least one sensor 76. The sensor 76 is implemented by a strain gauge as similar to the sensor in the sixth embodiment, and controlling unit 25M is similar in structure to the controlling unit 25, and, for this reason, no further description is hereinafter incorporated.

The valve actuator 22M is implemented by an ultrasonic motor 77 as similar to the valve actuator in the seventh embodiment, and the ultrasonic motor 77 has an output shaft coupled to the shaft 62A. The ultrasonic motor 77 and sensor 76 are connected to the controlling unit 25M.

When a player wishes to change the pitch of tone or tones, he or she depresses the key 64. Then, the controlling unit 25M supplies the driving signal S7 to the ultrasonic motor 77, and the driving signal S7 gives rise to rotation of the output shaft of the ultrasonic motor 77. As a result, the valve body 62 is changed from the first valve position to the second valve position through the rotation of valve body 62. The connecting portions 71 and 72 are connected to the connecting portions 73 and 74 through the air passages 62B and 62C, and the length of air column is changed.

When the player wishes to restore the tone or tones to the previous pitch, he or she releases the key 64. Then, the controlling unit 25M changes the driving signal S7 to the inactive level so that the return spring 67 causes the key 64 to the previous key position. Accordingly, the valve body 62 is rotated in the opposite direction. This results in the change in length of air column. Thus, the supporting system 1M behaves as similar to the supporting system 1, and achieves all the advantages of the supporting system 1.

Although particular embodiments of the present invention have been shown and described, it will be apparent to those skilled in the art that various changes and modifications may be made without departing from the spirit and scope of the present invention.

The trumpet does not set any limit to the technical scope of the present invention. The supporting system may appertain to brasses with piston valves such as, for example a tuba and other sorts of wind instrument equipped with mouthpieces such as, for example, a cornet, a flugelhorn, a euphonium, an alto horn, a baritone and a sousaphone.

The wind instruments with the mouthpieces do not set any limit to the technical scope of the present invention. The supporting system may be designed for wind instruments with leads such as, for example, an oboe, a clarinet and a saxophone. Since these wind instruments do not have any valve assembly, the supporting system makes it possible quickly to close and open the tone holes by means of the keys.

The directions of air passages 12A and 12B do not set any limit to the technical scope of the present invention. Another valve may have curved air passages, and yet another valve may have air passages interconnecting ports provided on a cross section of the valve.

The controlling unit 25 may be physically independent of the metal musical instrument. In this instance, long cables are required for the electrical connection between the metal musical instrument and the controlling unit/pressure sensors 25/23.

The pressure sensors 23 do not set any limit to the technical scope of the present invention. The finger buttons 15 or rods 21 may be monitored with photo-reflectors or photo-interrupters. In this instance, the photo-reflectors or photo-interrupters are provided inside or outside of the valve casings 11.

The power source may be implemented by a transformer to which electric power is supplied from the outside of the controlling unit 25.

The ultrasonic motor 37A may permit the return spring 13 to move the valve 12 toward the rest position without any exertion of upward force.

The electromagnetic valves 44A/45A and air tubes 44/45 may be removed from the pneumatic control system. In this instance, when a player releases the finger button 15, the electromagnetic air supply valve 42A turns off, and the electromagnetic air exhaust valve 43A turns on so that the valve 12 returns to the rest position by means of the return spring 13.

The pneumatic system 39 may be replaced with a hydraulic system, in which pressurized oil or pressurized water is supplied to a hydraulic actuator connected to the valve 12.

The sensor in any one of the seventh to twelfth embodiments may be replaced with the sensor in any one of the second to sixth embodiments. An electrostatic touch sensor may be used in another supporting system.

The ultrasonic motor may be replaced with a direct-current motor of the type exerting a torque on the rod 21 at the end position.

More than one sort of the valve actuators 22 to 22M may be used in still another supporting system for a wind musical instrument.

The supporting system may be provided for selected one or ones of the valve assemblies. In other words, the supporting system does not assist a human player in the fingering on the other valve assembly or assemblies.

The component parts of the above-described embodiments are correlated with claim languages as follows. The mouthpiece serves as a "vibration exciter", and the valve mechanism 5 or valve assemblies 10, 10A, 10B, 10C, 10D, 10E, 10F, 10G, 10H, 10J, 10K, 10L and 60 serve as a "pitch changing mechanism".

The holes, which are connected to the inlet portion 17 and outlet portions 18/19, serve as "ports". The finger button 15 and rod 21 or the key 64 and links 65 as a whole constitute a "manipulator". The combination of pinion 37B and rack 37C, combination of pneumatic actuator 40*b*, electromagnetic air supply valves 42A/44A, electromagnetic exhaust valves 43A/45A and air guide tubes 42/43/44/45, pantograph 47A or links 65 serves as a "motion converter".

What is claimed is:

1. A wind musical instrument for producing tones, comprising:

a pipe structure defining a column of air therein;

a vibration exciter connected to said pipe structure, and used to give rise to vibrations of said column of air in said pipe structure;

a pitch changing mechanism provided on said pipe structure, and selectively manipulated for changing a length of said column of air; and a supporting system provided in association with said pitch changing mechanism for mechanically assisting a human player in manipulating said pitch changing mechanism, said supporting system includes at least one sensor provided in association with said pitch changing mechanism and producing a detecting signal representative of the manipulating of said pitch changing mechanism, at least one actuator connected to a valve forming a part of said pitch changing mechanism and used for changing the length of said column of air, said at least one actuator responsive to a driving signal so as to mechanically assist said human player in said manipulating, and a controlling unit connected to said at least one sensor and said at least one actuator, analyzing said detecting signal for an intention of said human player and supplying said driving signal to said at least one actuator for mechanically assisting said human player in said manipulating, wherein said valve is monitored by said at least one sensor so that said controlling unit determines whether or not said human player gives rise to a movement of said valve.

2. The wind musical instrument as set forth in claim 1, in which said valve is formed with plural air passages and reciprocally moved in a valve casing of said pitch changing mechanism so as to cause one of said plural air passages to form a part of said column of air.

3. The wind musical instrument as set forth in claim 1, in which said valve is formed with plural air passages and rotatable in a valve casing of said pitch changing mechanism so as selectively to connect said plural air passages to plural ports of said valve casing connected to said pipe structure.

4. The wind musical instrument as set forth in claim 1, in which said valve is connected to a manipulator, and said at least one sensor monitors said manipulator so that said controlling unit determines whether or not said human player fingers on said manipulator.

5. The wind musical instrument as set forth in claim 1, in which said at least one actuator has an energy converter selected from the group consisting of a solenoid, an ultrasonic motor, a surface acoustic wave motor, a direct current motor, an air pump, a hydraulic motor, a piece of shape memory alloy, a polymer actuator and a piezoelectric element.

6. The wind musical instrument as set forth in claim 5, in which said at least one actuator further has a motion converter connected between said energy converter and said valve so as to convert a first sort of motion in said energy converter to a second sort of motion of said valve.

7. The wind musical instrument as set forth in claim 1, in which said at least one sensor converts pressure, displacement, velocity, acceleration or strain to a detecting signal supplied to said controlling unit.

8. The wind musical instrument as set forth in claim 7, in which said at least one sensor is selected from the group consisting of a pressure sensor, a combination of a magnetic scale and a magnetic sensor, a combination of a piece of magnet and an electromagnetic pickup, a three axial piezoelectric acceleration sensor or a strain gauge.

9. The wind musical instrument as set forth in claim 1, in which said controlling unit is fitted to said pipe structure.

10. A supporting system combinable with a wind musical instrument, comprising:

at least one sensor provided in association with a pitch changing mechanism of said wind musical instrument, said pitch changing mechanism changing a length of a column of air in said wind musical instrument and producing a detecting signal representative of fingering of a human player on said pitch changing mechanism;

at least one actuator connected to a valve forming a part of said pitch changing mechanism and used for changing said length of said column of air, said at least one actuator responsive to a driving signal so as to mechanically assist said human player in manipulating said pitch changing mechanism; and a controlling unit connected to said at least one sensor and said at least one actuator, analyzing said detecting signal for an intention of said human player, and supplying said driving signal to said at least one actuator for mechanically assisting said human player in manipulating said pitch changing mechanism, wherein said valve is monitored by said at least one sensor so that said controlling unit determines whether or not said human player gives rise to a movement of said valve.

11. The supporting system as set forth in claim 10, in which said valve is formed with plural air passages and reciprocally moved in a valve casing of said pitch changing mechanism so as to cause one of said plural air passages to form a part of said column of air.

12. The supporting system as set forth in claim 10, in which said valve is formed with plural air passages and rotatable in a valve casing of said pitch changing mechanism so as selectively to connect said plural air passages to plural ports of said valve casing connected to said pipe structure.

13. The supporting system as set forth in claim 10, in which said valve is connected to a manipulator, and said at least one sensor monitors said manipulator so that said controlling unit determines whether or not said human player fingers on said manipulator.

14. The supporting system as set forth in claim 10, in which said at least one actuator has an energy converter selected from the group consisting of a solenoid, an ultrasonic motor, a surface acoustic wave motor, a direct current motor, an air pump, a hydraulic motor, a piece of shape memory alloy, a polymer actuator and a piezoelectric element.

15. The supporting system as set forth in claim 14, in which said at least one actuator further has a motion converter connected between said energy converter and said valve so as to convert a first sort of motion in said energy converter to a second sort of motion of said valve.

16. The supporting system as set forth in claim 10, in which said at least one sensor converts pressure, displacement, velocity, acceleration or strain to a detecting signal supplied to said controlling unit.

17. The supporting system as set forth in claim 16, in which said at least one sensor is selected from the group consisting of a pressure sensor, a combination of a magnetic scale and a magnetic sensor, a combination of a piece of magnet and an electromagnetic pickup, a three axial piezoelectric acceleration sensor or a strain gauge.

* * * * *